US006095064A

United States Patent [19]

Millard et al.

[11] Patent Number: 6,095,064

[45] Date of Patent: Aug. 1, 2000

[54] METHOD FOR INCINERATING REFUSE AND FOR TREATING THE RESULTING SLAG

[75] Inventors: John Millard, London, United Kingdom; Hans Rüegg, Wohlen, Switzerland

[73] Assignee: ABB Alstom Power (Switzerland) Ltd, Baden, Switzerland

[21] Appl. No.: 09/168,994

[22] Filed: Oct. 9, 1998

[30] Foreign Application Priority Data

Oct. 13, 1997 [EP] European Pat. Off. ..... 97810771

[51] Int. Cl.[7] ..... F23J 3/00

[52] U.S. Cl. ..... 110/344; 110/346

[58] Field of Search ..... 110/342, 344, 110/346, 246, 255, 259

[56] References Cited

U.S. PATENT DOCUMENTS

| | | | |
|---|---|---|---|
| 4,542,703 | 9/1985 | Przewalski | 110/246 |
| 4,878,440 | 11/1989 | Tratz et al. | 110/259 X |
| 5,027,722 | 7/1991 | Schwyter | 110/344 X |
| 5,207,176 | 5/1993 | Morhard et al. | 110/246 |
| 5,671,688 | 9/1997 | Burgin et al. | 110/344 |
| 5,724,900 | 3/1998 | Tratz | 110/246 X |

*Primary Examiner*—Ira S. Lazarus
*Assistant Examiner*—Ljiljana V. Ciric
*Attorney, Agent, or Firm*—Burns, Doane, Swecker & Mathis, L.L.P.

[57] ABSTRACT

A method for the incineration of refuse in an incineration cylindrical rotary kiln and for treating the resulting slag from the incineration of the refuse. The method includes the steps of removing the slag or ash from the cylindrical rotary kiln in a dry state and immediately separating the slag or ash in a first screening stage into at least two fractions, including a first fraction or screen underflow having a particle size of less than 32 mm. The method includes the further steps of feeding the first fraction or screen underflow to a second classifying stage where the first fraction or screen underflow is separated into a fine function having a particle size of up to 2 mm and the further step of returning at least part of the fine fraction to an air-inlet side of the cylindrical rotary kiln for incineration of the fine fraction.

7 Claims, 2 Drawing Sheets

FIG. 1
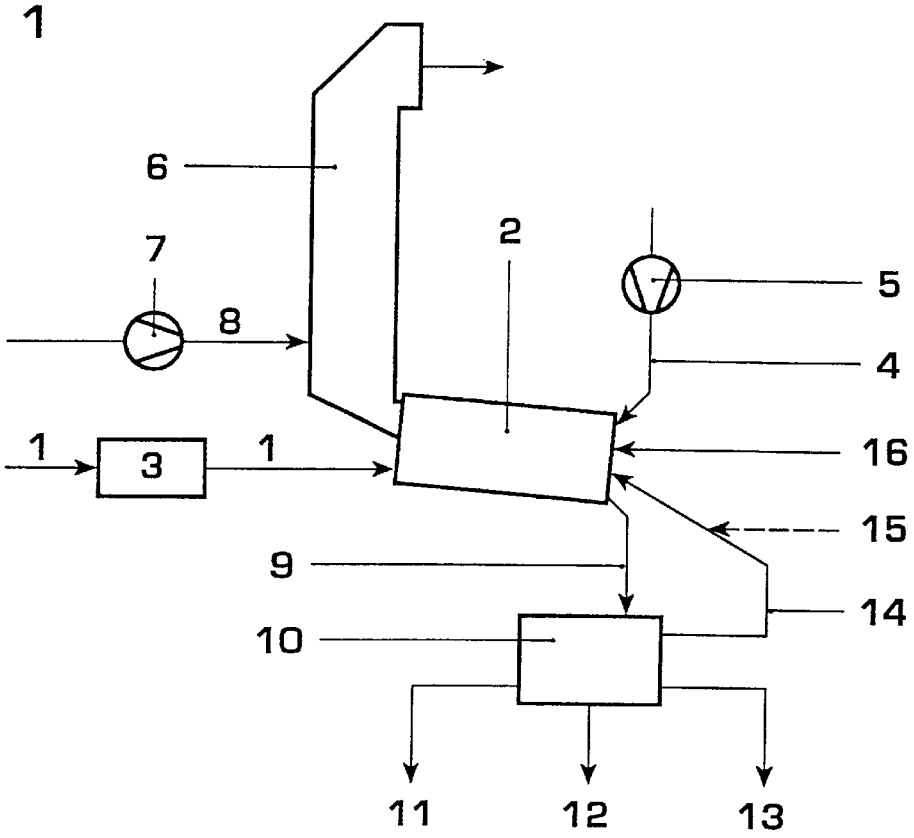
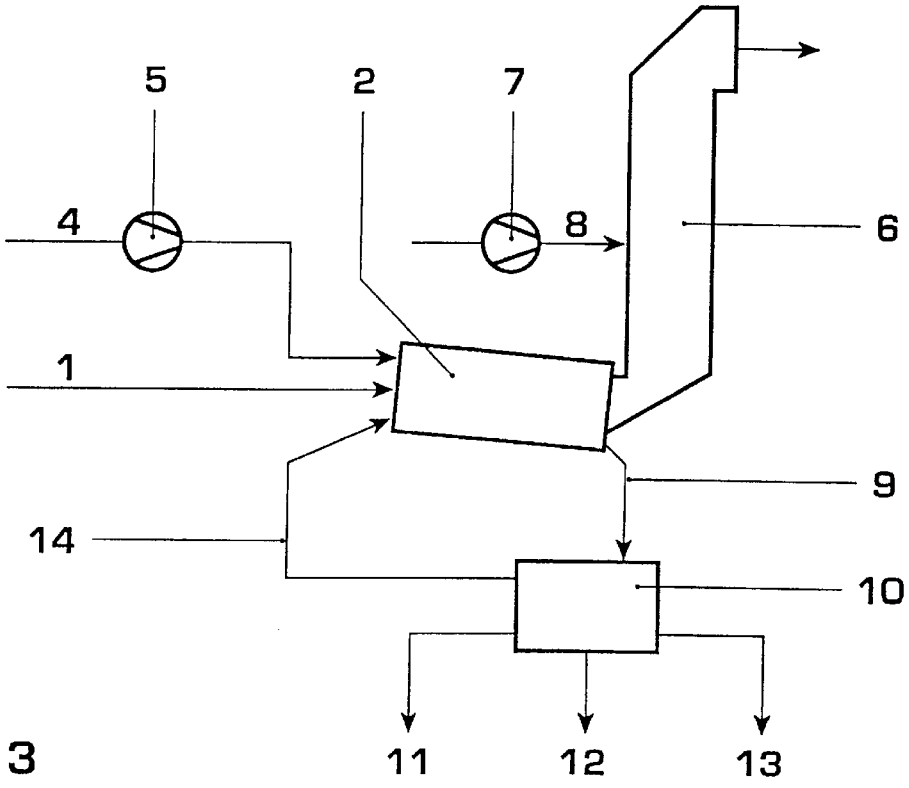
FIG. 3

METHOD FOR INCINERATING REFUSE AND FOR TREATING THE RESULTING SLAG

BACKGROUND OF THE INVENTION

1. Field of the Invention

The invention relates to the field of the thermal treatment of waste. It refers to a method for the incineration of refuse in an incineration furnace and for treating the slag from this refuse incineration.

2. Discussion of Background

The grate firing method is generally used currently for the incineration of domestic refuse. In this method, the refuse is moved mechanically over a horizontal or inclined plane and at the same time combustion air, which enters the bed of refuse from below through the grate, flows through the refuse. The incombustible fraction of the waste is removed from the incineration plant as grate ash or slag. While the grate firing method can be employed to excellent effect for refuse having a calorific value of over 6500 kJ/kg, it is not suitable for the incineration of refuse with lower calorific values, since in this case a high level of combustion-air preheating is required to dry the refuse, leading to disadvantageous strength and corrosion problems with the grate equipment.

EP 0 372 039 B1 has disclosed a method for treating the slag from waste incineration plants in which the slag is removed from the incineration furnace in the dry state, is subjected to crude cleaning (removal of unburnt coarse material and magnetic components), and then the crudely cleaned slag is separated into at least two fractions, and all the particles which are smaller than 2 mm are assigned to one fraction. This method is based on the knowledge that the fine fraction contains most of the pollutants which were originally contained in the slag. The fine fraction is fed to a special treatment, while the coarse fraction is suitable, for example, as a construction material.

A further development of this method is disclosed in EP 0 722 777 A1, which claims a method for the treatment of slag from refuse incineration plants in which the crude slag, after having passed through the firing grate, is immediately separated into at least two fractions, without prior quenching in a water bath, and these two fractions are treated further separately, the coarse fraction being fed to a wet deslagger. In the method, the first fraction, with a particle size of smaller than 80 mm, preferably smaller than 32 mm, is separated off in a first screening stage, the screen overflow is fed to wet deslagging, the screen underflow and, if appropriate, the grate underflow from the firing grate, is fed to a second screening stage for the purpose of separating the fine fraction having a particle size of up to 2 mm, the screen overflow from the second stage is mechanically comminuted, if appropriate after metallic and inert materials have been sorted out, and the screen underflow from the second stage is fed to a special treatment, e.g. a melting furnace. In this melting process, which is carried out, by way of example, in an arc furnace, a vitreous product which is readily suitable for landfill and a mental concentrate are produced (cf. F. -G Simon and K. -H. Andersson: InRec-Verfahren—Verwertung von Reststoffen aus der thermischen Abfallbehandlung [InRec process—Utilization of residual materials from the thermal treatment of waste], ABB Technik September 1995, pp. 15–20). This treatment method has thus far been put into practice for the slag from grate incineration furnaces, where it has proven useful. The high costs caused by the use of the arc furnace represent a disadvantage.

In addition to the grate incineration method for refuse, it is also known to incinerate refuse (predominantly special refuse) in a drum-type furnace. Drum-type furnaces essentially comprise a cylinder which is inclined in the direction of conveyance and is lined on the inside with refractory material or has a cooled hollow jacket. The refuse, which may be of differing consistency and condition, is fed to the drum at the top end of the drum in the co-current method, together with the combustion air, and is then incinerated in the drum. A drawback of this method is that the combustion air cannot flow through the bed of refuse, and as a result a poor slag burn-off is achieved. Although this can be avoided by prolonging the residence time of the refuse or by increasing the temperature in the drum, this in turn has the following drawbacks: the first measure leads either to a large drum-type furnace or to a low throughput, and the second measure leads to the slag melting, entailing high wear to lining material and hence to high treatment costs. For these reasons, in practice generally only special refuse is incinerated in the drum-type furnace, which refuse, owing to its varying consistency, cannot for its part be treated in the grate furnace.

For waste materials with a low calorific value and a particularly high water content, it is advantageous to employ the counter current principle in the drum-type furnace, i.e. the waste-slag path runs in the opposite direction to the combustion air/flue gas path. In this case, the vapors from the drying zone are diverted directly into the combustion chamber without affecting the rest of the firing area of the drum-type furnace. As a result, the waste materials become ignited throughout more quickly, and a shorter drum is sufficient for complete burn-off (K. J. Thomé-Kozmiensky: Thermische Abfallbehandlung [Thermal Treatment of Waste], EF-Verlag für Energie- und Umwelttechnik BmbH, second edition, 1994, p. 240).

A further drawback of using drum-type furnaces for the incineration of refuse consists in the fact that the mixing between slag and air therein is poor. Drum-type furnaces are operated with a high excess of air from 2.0 to 3.0 (K. J. Thomé-Kozmiensky: Thermische Abfallbehandlung [Thermal Treatment of Waste], EF-Verlag für Energie- und Umwelttechnik GmbH, 2nd edition, 1994, p.239), leading to high NOx values which, however, ought to be kept as low as possible for environmental protection reasons.

SUMMARY OF THE INVENTION

The invention aims to avoid all these drawbacks. Accordingly, one object of the invention is to provide a novel, efficient and cost-effective method for the incineration of refuse in an incineration furnace and for treating the slag from this refuse incineration, which method is to be realized using robust and simple design engineering, can be used even for refuse with a low calorific value and in which only low NOx emissions are produced. Moreover, it is intended for a slag which is low in pollutants to be produced, which slag is to be treated in such a way that the remaining materials can be utilized in further processes.

According to the invention, this is achieved, in the case of a method for the incineration of refuse in an incineration furnace and for treating the slag from this refuse incineration, in which method the slag is removed from the incineration furnace in the dry state and is immediately separated into at least two fractions, the first fraction, having a particle size of up to approximately 32 mm, being separated in a first screening stage and the screen underflow being fed to a second classifying stage for the purpose of separating the fine fraction having a particle size of up to 2 mm, and the fine fraction being fed for special treatment, by the fact that the refuse is incinerated in a drum-type furnace, and that the fine fraction having a particle size of up to 2 mm from the slag treatment is returned to the drum-type furnace on the air-inlet side, where it is incinerated. In this case, the fine fraction may preferably be incinerated by means of a burner, but also by means of a fluidized-bed method.

The advantages of the invention consist in the fact that the ash burn-off, which is typically low when incineration takes place in the drum-type furnace, is increased and the slag is produced in a condition with a low content of pollutants. The mechanical complexity of the drum-type furnace used for the refuse incineration is low by comparison with the incineration grates which have hitherto preferably ben used. Owing to this simplicity of design engineering, the method can also be employed without problems in developing countries and countries which are at the stage of economic take-off.

It is particularly expedient if the drum-type furnace is operated with an air ratio of less than one, i.e. substoichiometrically. This has the advantage that only a small amount of nitrogen oxides are produced during the incineration. At the same time, a low flue-gas velocity is established in the drum, thus preventing dust and unburnt lightweight particles from being entrained by the gas stream. This also leads to the possibility of keeping the volume of flue gas at the end of the vessel low, so that only relatively small flue-gas purification installations are required.

Furthermore, it is an advantage if the screen underflow from the first screening stage is fed to a wind sifter, where it is separated into a carbon-rich light fraction (i.e. fine fraction) and an inert heavy fraction. The carbon-rich light fraction contains all the particles less than 2 mm. It is returned to the drum-type furnace and incinerated in a burner, leading to a temperature increase at the cold air-inlet end of the drum-type furnace.

Furthermore, it is advantageous if the drum-type furnace is operated in countercurrent mode when incinerating refuse with a calorific value less than 7 MJ/kg. If the combustion air is introduced into the drum-type furnace at the opposite end to where the refuse is added, this leads to the possibility of using the hot flue gases, which emit their heat very efficiently, via convection and radiation, to the drum lining and the refuse, very successfully for drying the wet refuse, so that successful incineration is possible.

However, the method according to the invention is also eminently suitable for the incineration of refuse with a high calorific value (greater than 7 MJ/kg). In this case, the drum-type furnace is operated in co-current mode.

Finally, it is advantageous, when incinerating refuse with a low calorific value, to inject additional fuel at the air-side end of the drum, so that the incineration conditions are improved further. The same is true if the combustion air is introduced into the drum-type furnace in the preheated state. In this case, it is expedient for the air to be preheated by the hot flue gases which are cooled, for example, in a radiant cooler or for the combustion air to be used first of all as cooling air for cooling the outer casing of the drum.

Furthermore, it is expedient if the refuse is precompacted by mechanical compression before entering the drum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a schematic depiction of the method according to the invention in a first variant embodiment (drum-type furnace operated in countercurrent mode);

FIG. 3 shows a schematic depiction of the method according to the invention in a second variant embodiment (drum-type furnace in co-current mode).

Figure 2:
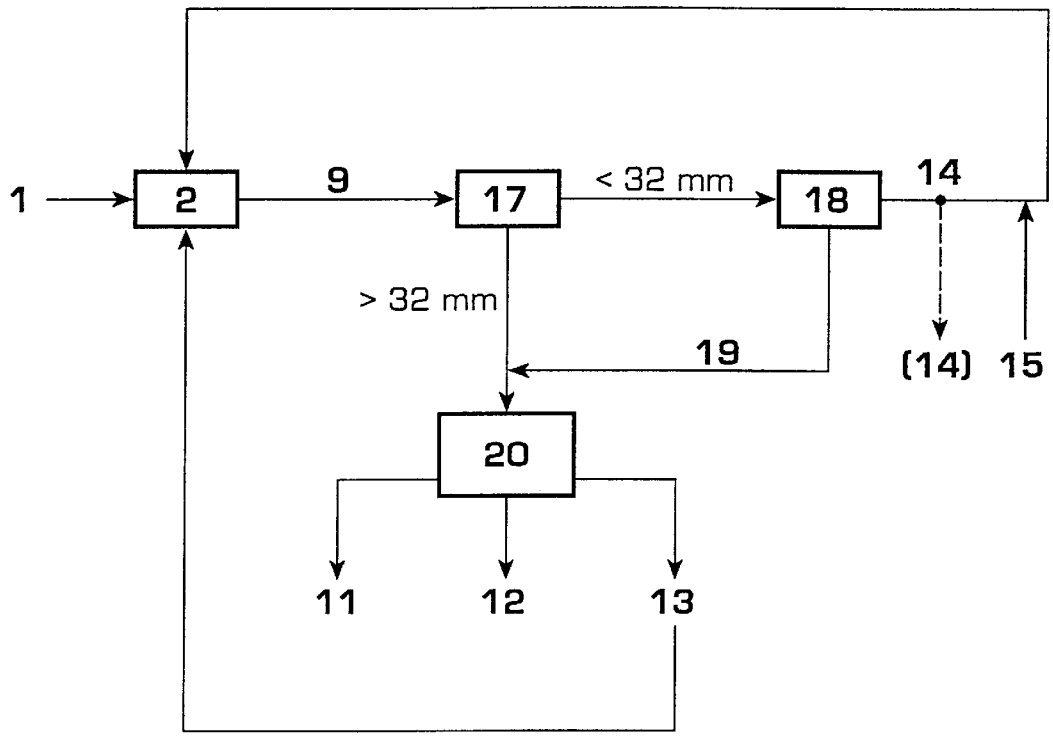
FIG. 2 shows a detail from FIG. 1 (slag treatment)

Only the components which are essential to understanding the invention are shown. The direction of flow of the media is indicated by arrows.

DESCRIPTION OF THE PREFERRED EMBODIMENTS

Referring now to the drawings, wherein like reference numerals designate identical or corresponding parts throughout the several views, the invention is explained in more detail with reference to exemplary embodiments and FIGS. 1 to 3.

FIG. 1 shows a schematic depiction of the method according to the invention in a first variant embodiment. The intention is to incinerate refuse 1 having a low calorific value (4.5 MJ/kg). In this exemplary embodiment, the refuse 1 consists of 28.5% combustible material, 46.9% water and 24.6% ash. A refuse composition of this nature is typical, by way of example, for Asian countries and developing countries.

The refuse 1 is fed to a drum-type furnace 2 via a feed device (not shown). The refuse 1 may optionally be mechanically precompacted in a press 3 before entering the drum-type furnace, in which case the press 3 may advantageously be integrated in the feed device.

In this first exemplary embodiment, the drum-type furnace 2 is 25 m long and has a diameter of 5 m. It is operated in countercurrent mode, i.e. the refuse 1 is introduced at the top end of the drum, which is inclined in the direction in which the refuse 1 is conveyed, and the combustion air (primary air 4) is fed in at the lower end of the drum via a blower 5. The waste/slag path therefore runs in the opposite direction to the path of the combustion air/flue gas. A post-combustion chamber 6 is connected to the upper end of the drum 2. The secondary air 8 is fed into the post-combustion chamber 6 by means of a blower 7. While a maximum temperature of 1000° C. prevails in the drum-type furnace 2, the temperature at the end of the post-combustion chamber 6 is approx. 850° C. The drum-type furnace 2 is operated substoichiometrically, i.e. with an air ratio less than one. The volume of primary air 4 supplied is 39,000 $Nm^3/h$, the volume of flue gas at the upper drum end is 673,400 $Nm^3/h$, and the volume of flue gas at the outlet from the post-combustion chamber 6 is 98,000 $Nm^3/h$.

The refuse 1 is continuously fed into the drum-type furnace 2 and transported through the furnace 2. In the process, it is heated to a temperature of more than 500° C. and the combustible constituents are incinerated. At the lower end of the drum-type furnace 2, the slag (ash) 9 is removed in the dry state, i.e. without quenching in a water bath, and is subjected to a dry or semidry sorting and classifying process, such as those described, by way of example, in EP 0 722 777 A1, EP 0 691 160 A1 or EP 0372 039 B1. Reference is expressly made here to these documents, so that there is no need in this document to give a detailed description of how to reclaim products of value from refuse incineration slag. The various sorting, classifying and comminution devices are denoted generally by 10, which devices can be used, on the one hand, to obtain scrap iron 11, conferrous metals (primarily Cu, Al) 12 and inert slag 13, which can be exploited further in the economy, and on the other hand, to obtain the fine fraction having a particle size of up 2 mm (carbon-rich light fraction) 14, which is returned to the drum-type furnace 2 at the air-inlet side. The carbon-rich light fraction 14 can either be incinerated immediately via a burner at the drum end or may optionally be enriched with carbon 15 in a further intermediate step before it is returned to the drum-type furnace 2. Moreover, it is possible to feed in additional fuel 16 directly at the lower end of the drum-type furnace, in order to improve the incineration. An improvement is also achieved if preheated combustion air is used, it being possible, by way of example, for the combustion air to be preheated by the hot flue gas in a radiant cooler, or the air is initially used for cooling the outer casing of the drum and is then employed as combustion air.

FIG. 2 gives a detailed illustration of the slag treatment, again for the first exemplary embodiment. The slag 9 leaving the drum-type furnace 2 is screened, in a first screening stage 17, on a roller grate, the screen underflow having a particle size less than 32 mm being fed to a second classifying stage 18, in this case a zigzag wind sifter. In the zigzag wind sifter, the screen underflow from the first screening stage 17 is separated into a carbon-rich light fraction (fine fraction 14) and an inert heavy fraction 19. The light fraction 14 may be additionally enriched with carbon 15 or may be returned directly to the drum-type furnace. Naturally, if required, it is also possible to return only part of the light fraction 14 to the furnace 2. The screen overflow having a particle size greater than 32 mm is combined with the inert heavy fraction 19 from the zigzag wind sifter and is separated from its metallic constituents by means of ferrous or nonferrous metal separator 20. After the removal of scrap and comminution, the screen overflow having a particle size greater than 32 mm is returned to the drum-type furnace 2. The problem is presented by coarse unburnt constituents, such as for example books and melons. They may either be sorted out manually and returned or else the entire coarse fraction is returned to the furnace after having been comminuted.

The combination according to the invention of refuse incineration in the drum-type furnace with returning and incinerating at least part of the fine fraction 14 of the slag 9 leads to the serious drawback of drum-type furnaces (low ash furnaces) being eliminated. Moreover, the substoichiometric incineration in the drum, in conjunction with the post-combustion at low temperatures, reduces the NOx emissions in comparison with grate firing methods. The robust and simple design engineering of the drum-type furnaces moreover represents a considerable advantage when the method according to the invention is used in developing countries and countries which are at the stage of economic take-off.

FIG. 3 shows a schematic depiction of the method according to the invention in a second variant embodiment. In this case, it is intended to incinerate refuse 1 with a high calorific value (more than 7 MJ/kg), as is produced, by way of example, in European countries. The method in accordance with FIG. 3 differs from the variant embodiment illustrate in FIG. 1 only in that the drum-type furnace 2 is operated in co-current mode, i.e. both the refuse 1 and the combustion air (primary air (4), which has previously been compressed in a compressor 5, are fed in at the upper end of the drum, which is inclined in the direction in which the refuse 1 is conveyed. Hence the waste/slag path runs in the same direction as the combustion air/flue gas path. In this case, according to the invention, part of or the entire fine fraction of the slag, which has previously been removed from the drum-type furnace 2 in the dry state and has been subjected to a dry sorting/classifying operation, is returned to the upper end of the drum-type furnace. Here too, the advantages which have already been described above result.

Further improvements in the efficiency of the method according to the invention are possible if, for example, the combustion air is preheated. This may be brought about by means of the hot flue gases, for example in a radiant cooler, or the combustion air is firstly, before the incineration operation, used for cooling the outer casing of the drum, and is preheated in the process.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A method for incinerating refuse and for treating the resulting slag, comprising the steps of:

introducing refuse into an incineration cylindrical rotary kiln;

incinerating the refuse in the incineration cylindrical rotary kiln thereby forming a slag or ash;

removing the slag or ash from the incineration cylindrical rotary kiln in a dry state;

immediately separating the slag or ash in a first screening stage into at least two fractions, a first fraction or screen underflow having a particle size of less than 32 mm;

feeding the first fraction or screen underflow to a second classifying stage and separating the first fraction or screen underflow into a fine fraction having a particle size of up to 2 mm; and returning at least part of the fine fraction to an air-inlet side of the cylindrical rotary kiln for incineration of the fine fraction.

2. The method as claimed in claim 1, where the incineration cylindrical rotary kiln is operated with an air ratio of less than 1.

3. The method as claimed in clam 1, wherein the second classifying stage includes a wind sifter which separates the first fraction or screen under flow into the fine fraction, which is a carbon rich light fraction, and an inert heavy fraction, the method further including the step of enriching the fine fraction with carbon before returning the fine fraction to the incineration cylindrical rotary kiln.

4. The method as claimed in claim 1, wherein the incineration cylindrical rotary kiln is operated in a countercurrent mode when incinerating refuse with a calorific value of less than 7 MJ/kg.

5. The method as claimed in claim 4, wherein an additional fuel is injected at the air-inlet side of the incineration cylindrical rotary kiln.

6. The method as claimed in claim 1, wherein the incineration cylindrical rotary kiln is operated in a co-current mode when incinerating refuse with a calorific value of greater than 7 MJ/kg.

7. The method as claimed in claim 1, wherein the refuse is precompacted by mechanical compression before being introduced into the incineration cylindrical rotary kiln.

* * * * *